US006553891B2

(12) United States Patent
Fiebing et al.

(10) Patent No.: US 6,553,891 B2
(45) Date of Patent: Apr. 29, 2003

(54) HYDROSTATIC VARIABLE DISPLACEMENT PUMP HAVING SPRINGS ARRANGED OUTSIDE THE SERVOCYLINDER PRESSURE CHAMBER

(75) Inventors: Carsten Fiebing, Jevenstedt (DE); Reinhardt Thoms, Neumunster (DE)

(73) Assignee: Sauer-Danfoss Inc., Ames, IA (US)

( * ) Notice: Subject to any disclaimer, the term of this patent is extended or adjusted under 35 U.S.C. 154(b) by 53 days.

(21) Appl. No.: 09/901,513

(22) Filed: Jul. 9, 2001

(65) Prior Publication Data

US 2002/0014149 A1 Feb. 7, 2002

(30) Foreign Application Priority Data

Aug. 1, 2000 (DE) ..... 100 37 482

(51) Int. Cl.[7] ..... F01B 13/04; F01B 3/00
(52) U.S. Cl. ..... 92/12.2; 91/506
(58) Field of Search ..... 92/12.2, 131; 91/506; 60/487

(56) References Cited

U.S. PATENT DOCUMENTS 3,429,225 A * 2/1969 Keyworth ..... 92/12.2
4,455,920 A * 6/1984 Shaw et al. ..... 92/12.2
5,226,349 A * 7/1993 Alme et al. ..... 92/12.2
5,673,606 A * 10/1997 Rose et al. ..... 92/12.2

* cited by examiner

*Primary Examiner*—Edward K. Look
*Assistant Examiner*—Michael Leslie

(57) ABSTRACT

A hydrostatic variable displacement pump has a swash plate (3), which is used to adjust the stroke of displacement pistons in a cylinder block. The swash plate has its angle position pivoted in relation to the stroke direction of the displacement pistons by means of a servosystem. The servosystem is fitted on the housing (6) of the variable displacement pump. The servosystem (4) has a pressure cylinder (18) and a servopiston (7), which together form a servocylinder pressure chamber (8). The servopiston (7) operates in the pressure cylinder (18), is subjected to compressive loading by means of a spring assembly (9,10) and has a piston with at least two servopiston surfaces (11, 12) subjected to the action of pressure.

14 Claims, 5 Drawing Sheets

HYDROSTATIC VARIABLE DISPLACEMENT PUMP HAVING SPRINGS ARRANGED OUTSIDE THE SERVOCYLINDER PRESSURE CHAMBER

FIELD OF INVENTION

The invention relates to a hydrostatic variable displacement pump of swash plate construction in which the servosystem is integrated in a servosystem housing designed as a cover; the cover closes off a housing opening of the variable displacement pump, a servoarm projecting through said opening for connection to the servosystem.

BACKGROUND OF THE INVENTION

In the known hydrostatic variable displacement pumps of swash plate construction which operate with a closed circuit, the displacement pistons are guided in cylinders of a cylinder block and rotate about the shaft of the variable displacement pump. During the rotation, the displacement pistons are supported on the swash plate by means of sliding blocks, each displacement piston executing a complete stroke with each 360° rotation. The swash plate has a planar running surface on which the sliding blocks slide, the displacement pistons being connected in an articulated manner to the sliding blocks.

The swash plate is usually referred to as a rocker device or adjustable-angle plate, to be precise depending on whether they are mounted in cylinder shells on rollers or can be pivoted about bearing journals. The swash plate is pivoted by adjustment of the servosystem such that the angle position of its running surface is changed in relation to the stroke direction of the displacement pistons. With the change in the angle position of the running surface of the swash plate, the stroke of the displacement pistons, and thus the volume stream produced by the pump, is changed. The force necessary for changing the angle position of the adjustable-angle plate is usually produced hydraulically by virtue of pressure being produced on one, two or possibly even more servopistons which act on the swash plate.

The axis of action of the servopistons is located outside the axis of rotation of the rocker device or adjustable-angle plate, with the result that a lever arm is thus produced. The servopiston or servopistons is/are connected directly or indirectly to the swash plate such that the force displacing the servopistons produces a pivoting torque of the swash plate via the lever arm.

Hydrostatic variable displacement pumps also require spring forces which guide the pivoting angle of the pump back to 0°, i.e. into the neutral position thereof, if the servo-adjustment means of the pump is not activated.

In pivot-through pumps, the swash plate can be pivot in opposite directions from the center position determined by the spring forces, with the result that two delivery directions are produced. For both delivery directions, there is in each case a volume stream which begins from zero and increases to a specific maximum value. As a result, the center position is also referred to as the zero position. It is often the case that the springs which determine the zero position are installed such that they act as compression springs both in the case of positive pivoting angles and in the case of negative pivoting angles.

Variable displacement pumps in which the springs are accommodated outside the servopiston and servocylinder and are connected to the actual servopiston of the servosystem via corresponding lever systems are known. This means that the springs, rather than acting directly on the moveable servopistons, act on the servopistons via force-deflecting means. (See FIG. 5).

In most of the known variable displacement pumps of the type described above, the springs are installed directly in the servocylinder pressure chamber formed by the servopiston and servocylinder. The springs are thus located in the chamber in which the servopressure for adjusting the angle position of the swash plate also acts. In this case, the springs do indeed act directly on the servopiston, i.e. the spring force is transmitted directly from the spring to the servopiston. However, the dimensioning of the springs is limited by the size of the servocylinder pressure chamber. This means that the spring force cannot be adapted to different force conditions and sizes of the servosystem independently of the size of the servocylinder pressure chamber.

In order that the springs always operate as compression springs regardless of the pivoting direction of the servosystem, they are prestressed between two spring plates. In such devices, a rod is located between the spring plates with a low as possible amount of axial displacement play. The two spring plates can be moved toward one another both in the servopiston and on the rod, but they cannot move apart from one another beyond the distance between the two spring plates. The rod is connected to the housing of the variable displacement pump such that it cannot be displaced axially. In this case, the rod has to be adjusted such that the springs, prestressed to the length between the two spring plates, position the swash plate such that the stroke of the displacement pistons becomes zero (see FIG. 4).

A disadvantage of this configuration is that the spring-force requirement, which determines the geometrical dimensions of the springs, also has an influence on the amount of space required in the servopiston and/or in the servocylinder. This produces an undesirable relationship between the necessary spring force and the necessary servopiston diameter with a corresponding servopiston stroke, which relationship restricts the flexibility of design relatively pronounced extent and cannot be broken up as desired by means of construction. This means that a large spring force also always requires corresponding large servopiston and servocylinder, and a large servocylinder pressure chamber. High spring forces for smaller servopistons and servocylinders are barely possible with such known systems. A further disadvantage of this configuration is that the overall space necessary for the spring produces a dead volume in the servocylinder pressure chamber. In particular in the case of large springs, the dead volume is often greater than the displacement volume of a servopiston stroke. As a result, the servocylinder pressure chamber is not emptied to the full extent during the stroke of the servopiston. If, for example, air is located in this chamber, then air extraction must additionally be ensured by corresponding design measures.

Also known are variable displacement pumps (see FIG. 3), in which the servopiston is arranged in the interior of the tank chamber of the variable displacement pump. There is provided a pivot-back piston against which the servocylinder operates and wherein the spring is arranged on the outer circumference of the piston (see FIG. 3). Double-acting servopistons with inner springs are also known, wherein the servopiston virtually always is arranged at right angles to the pump axis. The application of force for the lever arm in relation to the swash plates should be located as far as possible, as should the center line of the springs, on the center longitudinal axis of the servopiston, in order that the hydraulically mechanical forces on the servopiston do not try to press the servopiston onto the wall of the servocylinder and thus increase friction and wear. This is only expedient in practice, however, when all the springs are located on one side of this application of force (see, in particular, FIG. 4).

In another prior art system the hydrostatic variable displacement pump has a cylinder block in which displacement pistons are guided and circulate with the cylinder block. The displacement pistons are supported on a swash plate, which can have its angle position pivoted in relation to the stroke direction of the displacement pistons, with the result that during the 360° rotation of the cylinder block, in which the displacement pistons execute a complete stroke, the stroke of said pistons can be adjusted.

The above servosystem has a piston device with at least two servopiston surfaces subjected to the action of pressure, the servopiston surfaces either being assigned to a single servopiston or each belonging to a separate servopiston. The spring device is arranged outside the servocylinder pressure chamber, around the servopiston, and two such devices are supported on the servosystem housing. This means that the servopiston is arranged wholly or partially in the interior of the compression springs, with the result that the size of the servocylinder pressure chamber is independent of the size of the spring and thus of the adjustable or selectable spring force. The forces of the compression springs are selected here such that they can guide back the pivoting angle of the variable displacement pump to the angle position 0° if the servo-adjustment means, i.e. the servosystem of the variable displacement pump, is not activated.

The spring device is installed outside the servopiston, with prestressing, between two spring plates, with the result that a compressive force is exerted on the adjustment piston in each position of the same. The servopiston itself may also be of split configuration here. For reliable abutment of the springs, the spring plate is arranged around the lateral surface of the piston. For reliable abutment of the spring plates, the servopiston is preferably of narrowed design. If the servopiston is not of narrow design, then the abutment for the spring plates may be established by securing rings or comparable elements in the axial direction of the servopiston, it being possible for the securing rings or the comparable elements to be inserted in grooves on the outer circumference of the servopiston, with the result that it is possible to select or even adjust the prestressing of the springs in accordance with the distance between the two spring plates.

The principal object of the invention is thus to provide a variable displacement pump having a servosystem in which it is possible to provide large spring forces, with the spring forces flowing directly to the servopiston, even if small servopistons.

A further object of the invention is to provide for the springs to be installed such that it is also possible for the servochambers to be sufficiently small to be emptied to the full extent, during a stroke of the servopiston.

SUMMARY OF THE INVENTION

According to the invention, the closed-circuit hydrostatic variable displacement pump has a servosystem in which either a double-acting servopiston or two servopistons acting directly or indirectly against one another are provided in the servo-adjustment means, the servopistons, being forced into the zero position by spring devices which always act as compression springs during each servopiston stroke, in any desired direction.

Two spring plates act on the servopiston with the corresponding prestressing, are, at the same time, supported in the servosystem housing of the variable displacement pump such that there is no axial displacement play (or at most a very small amount) in the "servopiston with compression spring" structural unit without the prestressing of the spring changing.

The servopiston is preferably designed as a single-part piston which is double-acting, with the result that two piston surfaces subjected to the action of pressure are provided. Each piston surface subjected to the action of pressure is preferably assigned a spring device. The maximum displaceability of the spring plates for the respective abutment of the spring device is ensured by corresponding shoulders in the interior of the servosystem housing, it being the case that, on account of the prestressing, the springs always act counter to the deflection of the angle position of the swash plate and try to force the latter back into its zero position.

The servosystem is fitted on the housing of the variable displacement pump. It preferably closes off the tank chamber of the variable displacement pump in the outward direction. It thus closes off the opening of the housing of the variable displacement pump through which a servoarm projects, the servosystem acting on said servoarm for adjusting the angle position of the swash plate. The housing of the variable displacement pump also has a large installation opening through which the installation unit comprising the swash plate and its corresponding bearings can be installed in the housing of the variable displacement pump. Corresponding bearing seats for accommodating the bearings are located in the housing of the variable displacement pump, with the result that alignment errors between the bearings mounting the swash plate can be avoided to the greatest possible extent. The servosystem has a servopiston for adjusting the angle of the swash plate, the servopiston, which operates in a servocylinder, forming a servocylinder pressure chamber together with the servocylinder and being displaceable, with hydraulic actuation, counter to the force of a spring device.

According to a development of the invention, the servoarm of the swash plate is arranged in the servosystem such that it is connected in an articulated manner to the servopiston along the line of action of the force exerted by the spring device. This means that the servoarm projects through the opening in the housing of the variable displacement pump, it being possible for the opening to be closed off by the servosystem, integrated in a cover, with the spring-device configuration. The servosystem housing, however, is preferably designed such that, in the state in which it is positioned on the housing of the variable displacement pump and fastened, it is open in the direction of the tank chamber of the variable displacement pump, with the result that the spring chamber is in fluid connection with the tank chamber of the variable displacement pump, but is sealed in the direction of the servocylinder pressure chamber by the actual servosystem piston guided in the pressure cylinder.

A spring plate which has an angled portion is preferably arranged between the servosystem housing and that side of the spring device which is directed toward the surface of the servopiston which is subjected to the action of pressure. The bottom collar of the pressure cylinder, which is screwed into the servocylinder housing, forms, for the angled spring plate, an abutment shoulder of the servosystem housing with respect to the axial displaceability of said spring plate.

The spring device is preferably at least one helical spring. However, it is also possible for two, three or more compression springs to be arranged around the outer circumference of the servopiston, with the result that a single helical spring can be replaced by at least two or more compressions springs.

In order for it to be possible to ensure a play-free spring arrangement, the distance between the shoulders in the servosystem housing is equal to the distance between the spring-plate abutments. A further advantage of the apparatus according to the invention is that the fact that the servosystem housing is open in the direction of the tank chamber of the variable displacement pump also results in a high level of flexibility as far as the dimensions of the spring arranged around the servopiston are concerned.

It is also an essential advantage of the apparatus that on account of the spring-device arrangement separated by the servocylinder pressure chamber, free selection is possible.

DESCRIPTION OF THE EMBODIMENTS OF THE INVENTION

Figure 1:
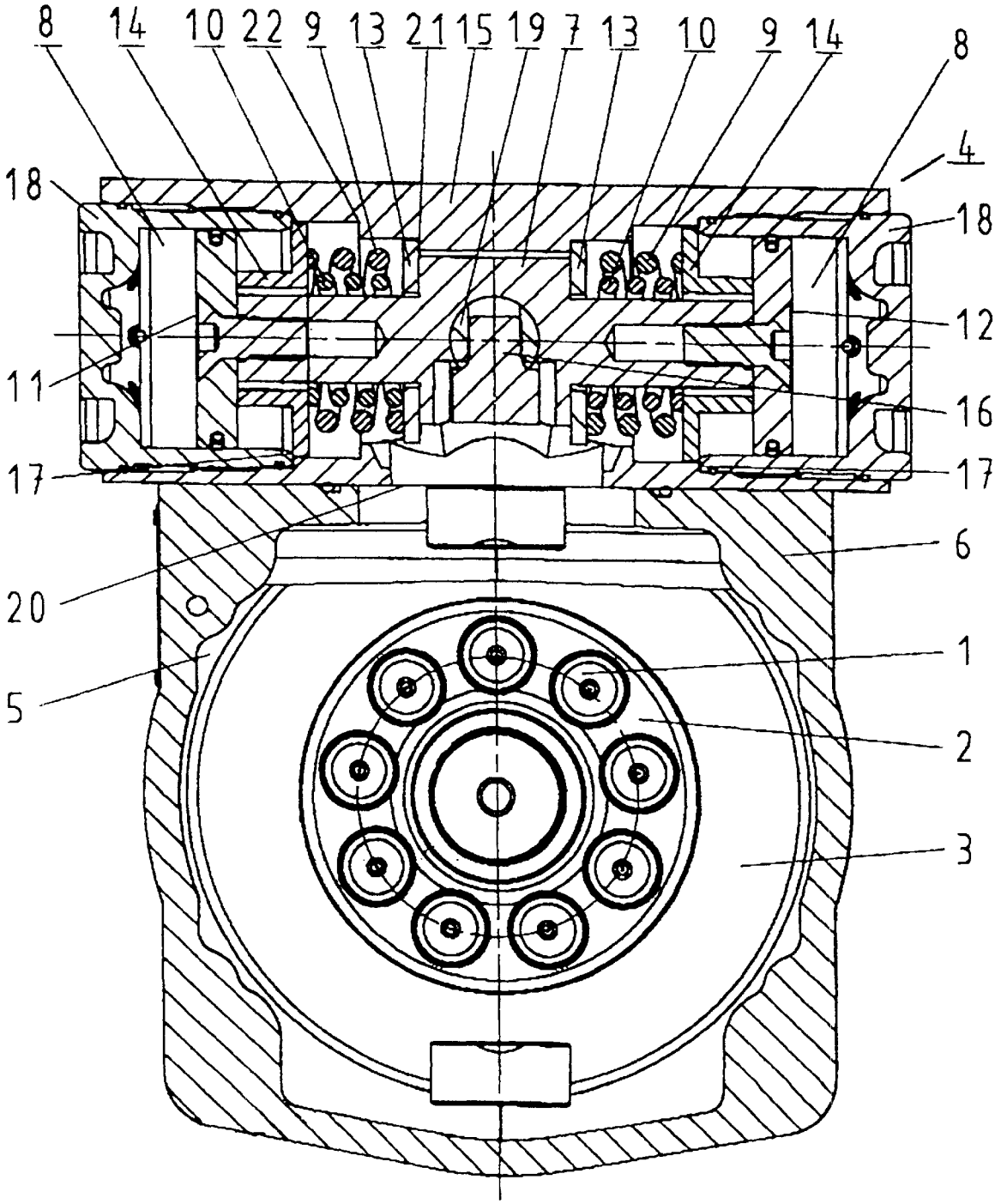
FIG. 1 is a sectional view of a variable displacement pump of this invention with the swash plate in the zero degree position.

FIG. 1 illustrates a sectional view of the variable displacement pump of this invention in which the section plane runs through the servosystem and the housing of the variable displacement pump. Illustrated in the bottom part of FIG. 1 are the displacement pistons 1, which are arranged in the cylinder block 2, concentrically to the axis of rotation thereof. The swash plate 3 is illustrated in plan view and has a sliding surface on which the displacement pistons 1 are supported for sliding action in sliding blocks (not illustrated). The cylinder block 2 and the swash plate 3 are arranged in a tank chamber 5 which is enclosed by a housing 6.

At its top end, the swash plate 3 has a servoarm 16 which projects through an opening 20 in the housing 6. At its end, the servoarm 16 has an angled portion which serves for connection to the servosystem 4. The servoarm 16 is of such a length, or the angled portion at the end of the servoarm 16 is designed such, that the line of action of the application of force exerted by the servopiston 7 runs through the angled portion of the servoarm 16.

When installed on the housing 6, the servosystem 4 closes off the opening 20, the servosystem 4 having a double-acting single-part servopiston 7 with two servopiston surfaces in respective servocylinder pressure chambers 8. The servopiston is narrowed in each case in the region of its underside and in this region, on the outer circumference of the narrowed portion supports in each case a first helical spring 10 and a second helical spring 9, which encloses the inner spring and is arranged in the opposite direction thereto. The region in which the springs 9, 10 are arranged is in fluid connection with the tank chamber 5 via the opening 20.

In its central region, the single-piece servopiston 7 has a cutout into which the angled portion of the servoarm 16 of the swash plate 3 extends. A sliding block 19 guides the angled portion of the servoarm 16 in an essentially play-free manner. In this central region of the servopiston, the latter is of thickened configuration and has a narrowed portion of reduced external diameter in the direction of the actual piston guided in the pressure cylinder 18. The actual pistons are inserted in this narrowed part of the servopiston 7 by means of a screw-connection. The pressure cylinder 18 is likewise inserted by means of a screw-connection in a corresponding lateral cutout of the servosystem housing 15, as far as a stop in the interior of the servosystem housing. The thickness of the cylinder wall of the pressure cylinder 18 is such that a shoulder-like collar 17 is formed on the stop shoulder for the pressure cylinder 18.

The springs 9, 10, which subject the servopiston 7 to compressive loading, are arranged between two spring plates 13, 14, which are designed as spacers. In the zero degree position of the swash plate 3, the inner spring plate 13 is supported on a shoulder in the transition between the narrowed and the thickened regions of the servopiston 7 and on a shoulder 21 in the interior of the servosystem housing 15, while the outer, angled spring plate 14 is supported on the underside of the actual piston and on the shoulder-like collar 17. The springs are dimensioned such that they always try to force the adjustable-angle plate into the zero degree position. This means that the springs always act as compression springs, in an essentially play-free manner, to be precise irrespective of the direction in which the servopiston 7 is displaced and thus the swash plate 3 is pivoted.

Figure 2:
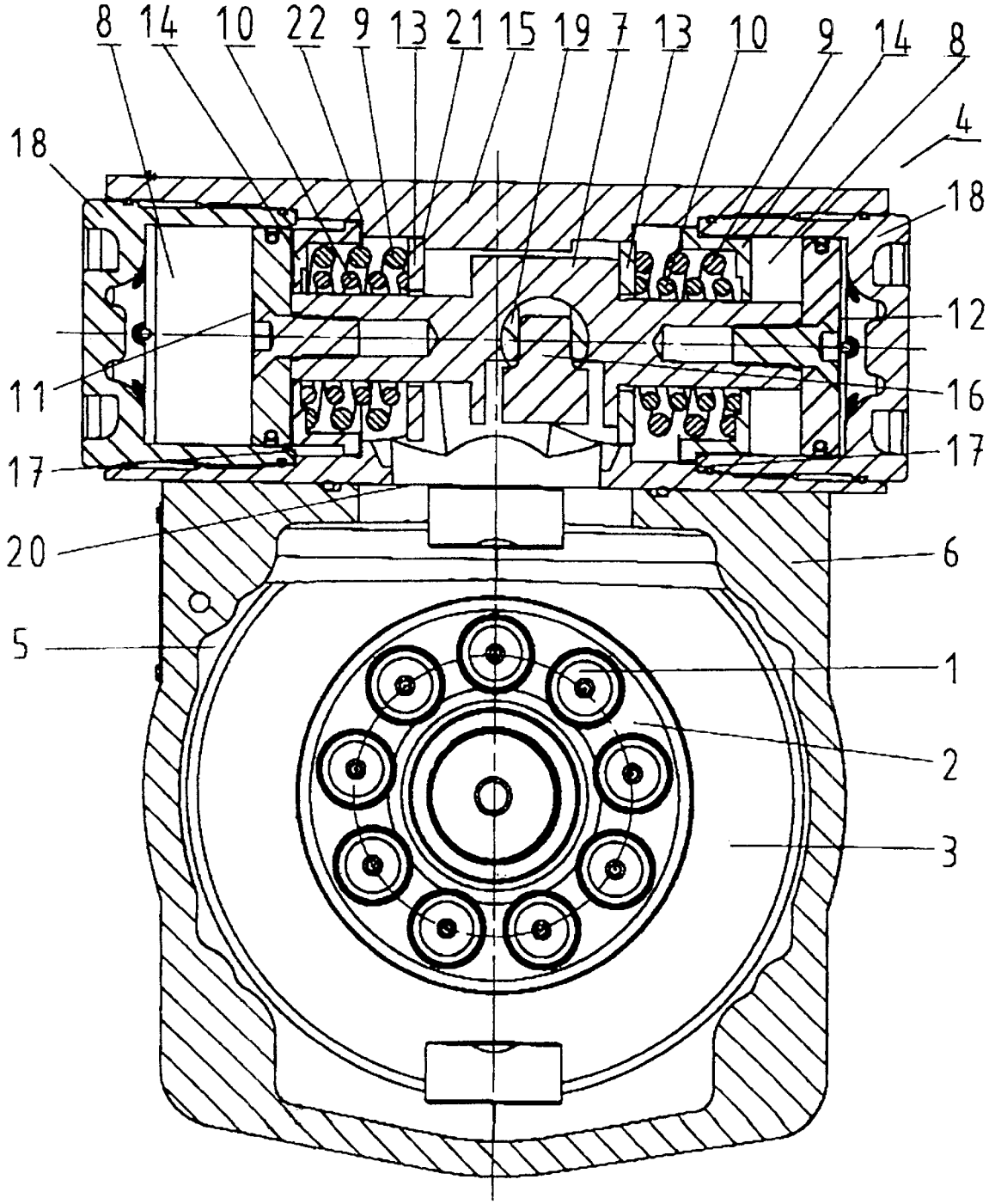
FIG. 2 is a sectional view according to FIG. 1 with the swash plate deflected out of the zero degree position.

FIG. 2 illustrates a sectional view of the second embodiment of the invention, the sectional view corresponding to the section plane according to FIG. 1. The difference from the embodiment of FIG. 1 is that the outer spring plate 14 has its angled portion on the outer circumference of the outer spring 9, whereas the outer spring plate 14 according to FIG. 1 has its angled portion in the region of the diameter of the narrowed portion of the servopiston 7. It is also possible, however, for the spring plate to be of two-part design with a bushing supported on the underside of the servopiston, a flat spring-plate part butting against the bushing. The length of the bushing is equal to the distance between the underside of the servopiston and the collar 17, in relation to the 0° position. It is also possible, however, for the piston underside to be correspondingly extended to the collar 17 instead of the bushing being provided.

In order to clarify the functioning of the spring system of the servosystem 4 according to the invention, FIG. 2 shows a position of the servopiston 7 in which the swash plate 3 has been deflected out of its zero degree position. This can be seen by way of the servopiston surface 11 of the piston which is illustrated on the left, this surface having executed a complete stroke, and by way of the right-hand piston, located essentially in the top dead-center position, in the right-hand servocylinder pressure chamber. In other words, the position illustrated corresponds to the swash plate 3 having pivoted out to the maximum extent in one delivery direction.

During the stroke of the actual left-hand servopiston to the bottom dead-center position, the inner spring plate 13 butts against the shoulder 21 of the servosystem housing 15, while the outer angled portion of the outer spring plate 14 butts against the shoulder 22 in the servosystem housing 15. This shoulder 22 serves, at the same time, as a stroke-limiting means for the actual piston.

By virtue of the movement of the actual left-hand piston in the direction of the bottom dead-center position, the inner spring plate 13 of the actual right-hand piston is displaced into the region of the shoulder 21, but only to the extent where reliable seating or reliable support of the spring on the inner spring plate 13 is ensured. The outer spring plate 14, by way of its outer angled portion, is forced by the spring to such an extent that it butts against the collar 17 on the end side of the pressure cylinder 18.

On account of the extent of the distances between the shoulder on the collar 17 and the shoulders 21, and the movement path of the servopiston from the top dead-center position to the bottom dead-center position, e.g. the maximum stroke thereof, and the corresponding dimensioning of the springs, the latter are arranged on the servopiston, outside the servocylinder pressure chamber, in an essentially play-free manner, permanently subjecting the servopiston to compressive loading, and ensuring reliable and essentially delay-free pivoting of the swash plate 3 of the variable displacement pump.

Figure 3:
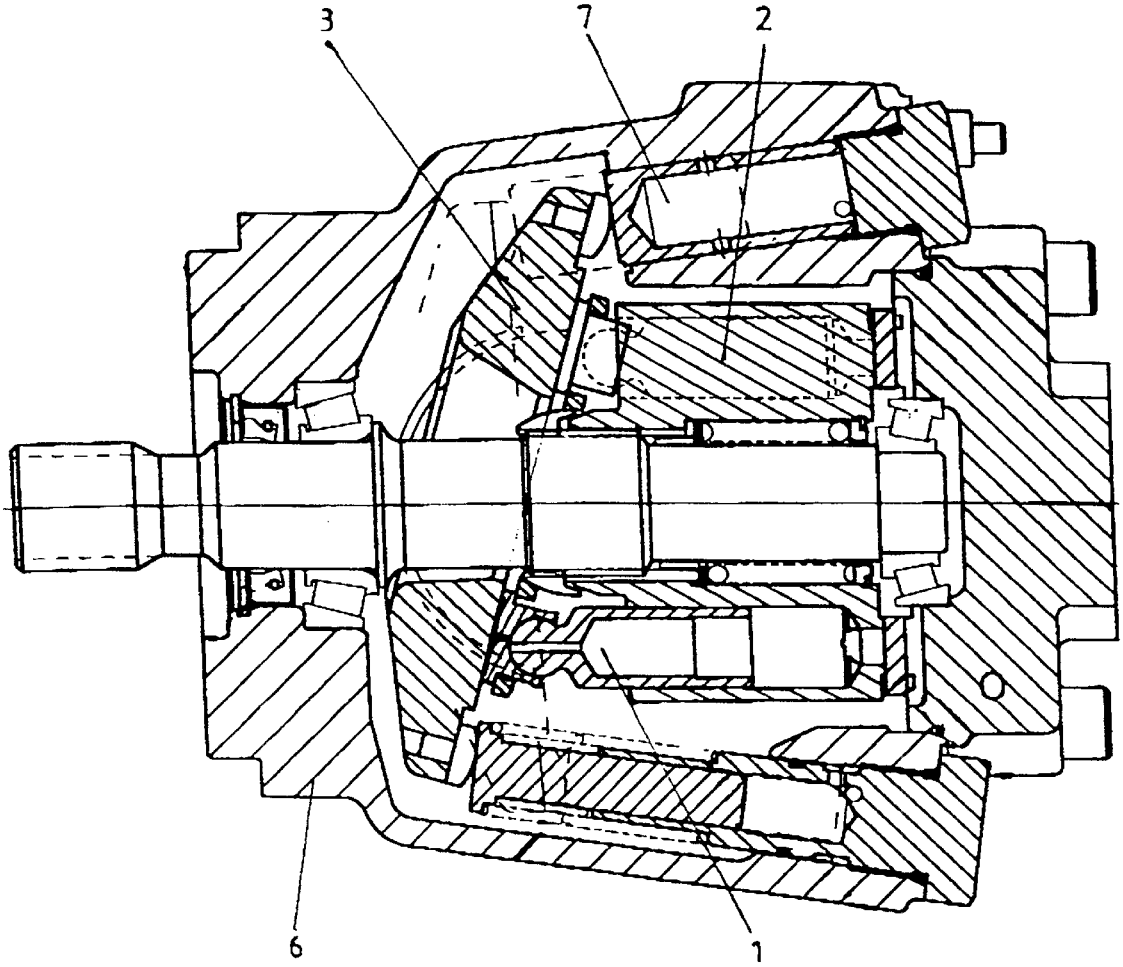
Fig. 3 PRIOR ART
FIG. 3 is a sectional view of a prior art variable displacement pump.

FIG. 3 shows a prior-art variable displacement pump in which a pivot-back piston with a spring arranged on its outer circumference, in the direction of the tank chamber, is illustrated. The adjustment piston itself, in contrast, does not have any spring arranged on its outer circumference. In this pump, the servosystem is not integrated in a separate servosystem housing. The spring is only supported with one side on the housing and one side on the servopiston and, accordingly, does not produce the zero degree position.

Figure 4:
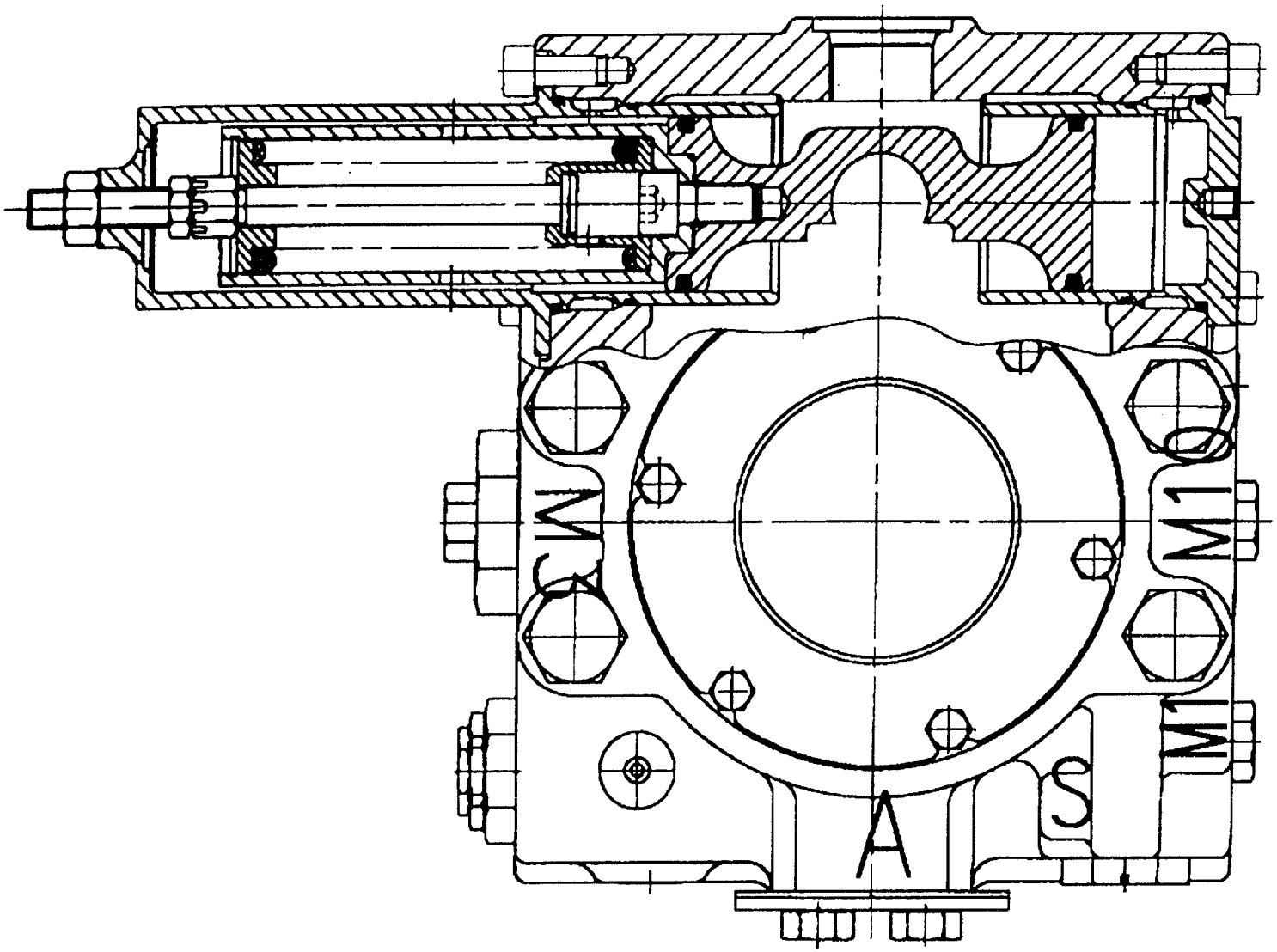
Fig. 4 PRIOR ART
FIG. 4 is a sectional view of a further prior art variable displacement pump.

FIG. 4 illustrates a further prior-art variable displacement pump. In this pump, the spring device, for restoring the servopiston, is arranged on one side of the double-acting servopiston such that the spring device is arranged in the interior of the servocylinder pressure chamber and has a rod, which leads through the pressure chamber, passing through it.

Figure 5:
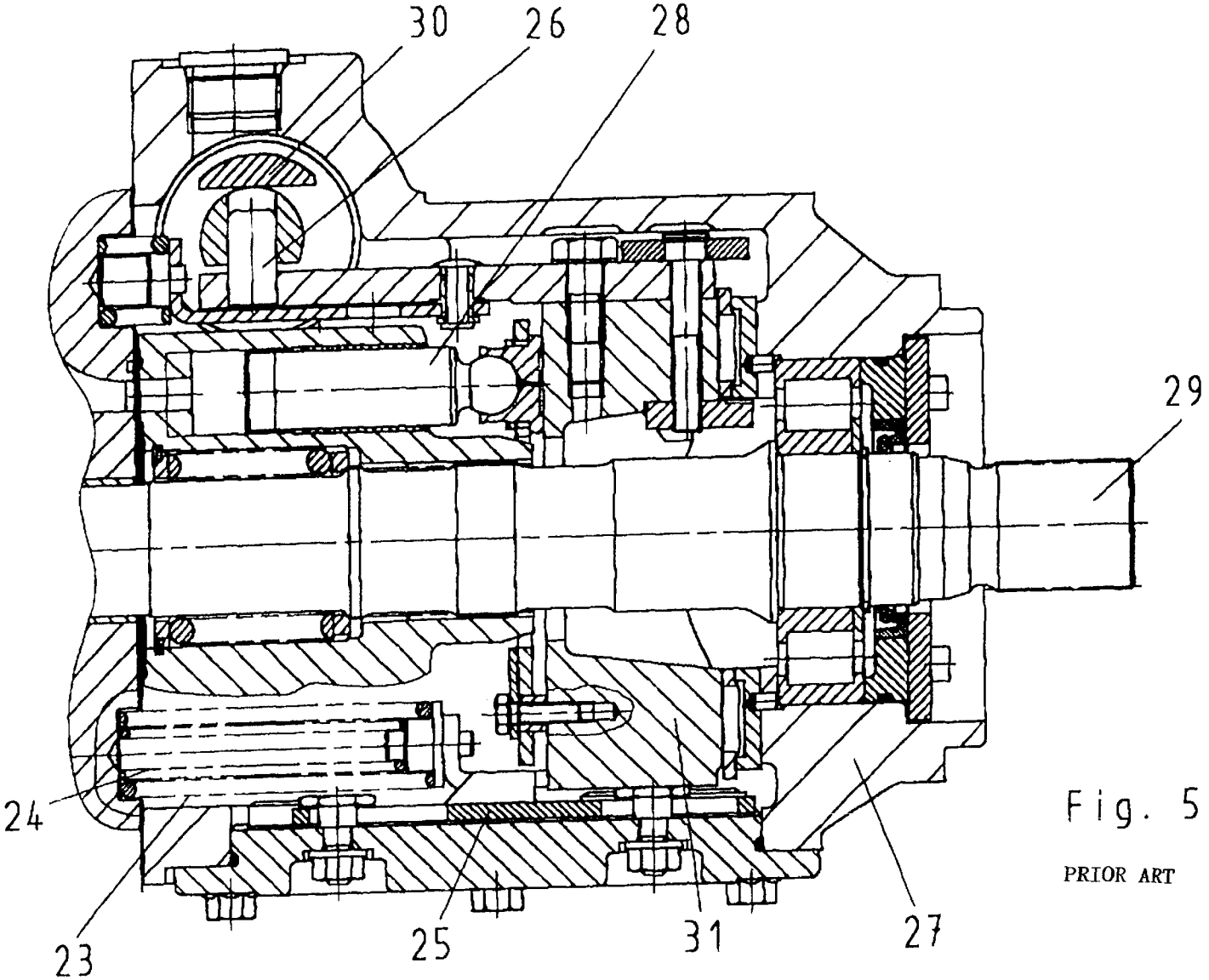
Fig. 5 PRIOR ART
FIG. 5 is a sectional view of a further prior art variable displacement pump.

FIG. 5 shows a further prior art variable displacement pump. This variable displacement pump has a centrally arranged shaft 29 which circulates in a housing 27 with the displacement piston 28, which is guided in a cylinder block. A spring device, which has an outer spring 23 and an inner spring 24, is arranged in the housing 27. The springs 23, 24 are fitted outside the servopiston 30, the force of which, for adjusting the rocker device 31, is introduced into the rocker device via a servoarm angled portion 26 and corresponding lever systems 25. It is thus the case that, rather than acting directly on the moveable servopiston, the springs 23, 24 act on the servopiston via force-deflecting means.

It is therefore seen that this invention will achieve at least all of its stated objectives.

LIST OF PARTS

1 displacement piston
2 cylinder block
3 swash plate
4 servosystem
5 tank chamber
6 housing
7 servopiston
8 servocylinder pressure chamber
9 outer spring
10 inner spring
11 servopiston surface of the left-hand piston (FIGS. 1 and 2)
12 servopiston surface of the right-hand piston (FIGS. 1 and 2)
13 inner spring plate
14 outer spring plate
15 servosystem housing
16 servoarm
17 collar
18 pressure cylinder
19 sliding block
20 large opening for servoarm
21 shoulder
22 shoulder
23 outer spring
24 inner spring
25 lever system
26 servoarm angled portion
27 housing
28 displacement piston
29 shaft
30 servopiston
31 rocker device

What is claimed is:

1. A hydrostatic variable displacement pump, comprising, a variable-displacement pump housing (6), a cylinder block (2) in the pump housing (6), displacement pistons (1) in the cylinder block, a swash plate pivotally mounted in the pump housing in operational contact with the displacement pistons (1) and which can have its pivotal position in relation to a stroke direction of the displacement pistons set by means of a servosystem (4) fitted on the pump housing;

a tank chamber in the pump housing;

the servosystem (4) having a servosystem housing (15) and at least one servopiston (7) in a pressure cylinder (18) in the tank chamber (5) which forms a servocylinder pressure chamber (8) within the cylinder (18), the servopiston (7) having at least two servopiston surfaces (11, 12) subjected to the action of fluid pressure, a spring assembly (9, 10) mounted in the servosystem housing (15) on the outside of the servocylinder pressure chamber (8) to subject the two servopiston surfaces (11, 12) to compressive loading, wherein the spring assembly (9, 10) has at least two compression helical springs, which are spaced apart by equal distances on an outer circumference of the servopiston (7).

2. A hydrostatic variable displacement pump, comprising, a variable-displacement pump housing (6), a cylinder block (2) in the pump housing (6), displacement pistons (1) in the cylinder block, a swash plate pivotally mounted in the pump housing in operational contact with the displacement pistons (1) and which can have its pivotal position in relation to a stroke direction of the displacement pistons set by means of a servosystem (4) fitted on the pump housing;

a tank chamber in the pump housing;

the servosystem (4) having a servosystem housing (15) and at least one servopiston (7) in a pressure cylinder (18) in the tank chamber (5) which forms a servocylinder pressure chamber (8) within the cylinder (18), the servopiston (7) having at least two servopiston surfaces (11, 12) subjected to the action of fluid pressure, a spring assembly (9, 10) mounted in the servosystem housing (15) on the outside of the servocylinder pressure chamber (8) to subject the two servopiston surfaces (11, 12) to compressive loading, wherein a spring plate (13, 14) is arranged between the servopiston (7), and the servosystem housing (4).

3. The hydrostatic variable displacement pump of claim 1 in which the swash plate (3) has a servoarm (16) which is arranged in the servosystem (4) such that it is connected in an articulated manner to the servopiston (7) along the line of action of the force exerted by the spring assembly (9, 10).

4. The hydrostatic variable displacement pump of claim 1, in which the servosystem (4) is connected to the pump housing (6) such that the part of the region which is located between an underside of the servopiston (7), is open in open communication with the tank chamber (5).

5. A hydrostatic variable displacement pump, comprising, a variable-displacement pump housing (6), a cylinder block (2) in the pump housing (6), displacement pistons (1) in the cylinder block, a swash plate pivotally mounted in the pump housing in operational contact with the displacement pistons (1) and which can have its pivotal position in relation to a stroke direction of the displacement pistons set by means of a servosystem (4) fitted on the pump housing;

a tank chamber in the pump housing;

the servosystem (4) having a servosystem housing (15) and at least one servopiston (7) in a pressure cylinder (18) in the tank chamber (5) which forms a servocylinder pressure chamber (8) within the cylinder (18), the servopiston (7) having at least two servopiston surfaces (11, 12) subjected to the action of fluid pressure, a spring assembly (9, 10) mounted in the servosystem housing (15) on the outside of the servocylinder pressure chamber (8) to subject the two servopiston surfaces (11, 12) to compressive loading, wherein a spring plate having an angled portion (14) is positioned between the servosystem housing (15) and the spring assembly (9, 10).

6. The hydrostatic variable displacement pump of claim 5, in which the angled portion (14) can be positioned on an end-side collar (17) of the pressure cylinder (18).

7. The hydrostatic varible displacement pump of claim 1, in which the spring assembly (9, 10) is dimensioned such that it always forces the swash plate (3) into the zero non-pivotal position.

8. The hydrostatic variable displacement pump of claim 1, in which the spring assembly (9, 10) is at least one helical spring.

9. A hydrostatic variable displacement pump, comprising, a variable-displacement pump housing (6), a cylinder block (2) in the pump housing (6), displacement pistons (1) in the cylinder block, a swash plate pivotally mounted in the pump housing in operational contact with the displacement pistons (1) and which can have its pivotal position in relation to a stroke direction of the displacement pistons set by means of a servosystem (4) fitted on the pump housing;

a tank chamber in the pump housing;

the servosystem (4) having at least one servopiston (7) located within a servosystem housing (15) and in a pressure cylinder (18) which forms a servocylinder pressure chamber (8) within the cylinder (18), the servopiston (7) having at least two servopiston surfaces (11, 12) subjected to the action of fluid pressure, a spring assembly (9, 10) mounted in the servosystem housing (15) about the exterior of the servopiston (7) to subject the two servopiston surfaces (11, 12) to compressive loading.

10. The hydrostatic variable displacement pump of claim 9 wherein an inner spring plate (13) is positioned about the servopiston (7) and operatively associated with the spring assembly (9, 10).

11. The hydrostatic variable displacement pump of claim 10, wherein the servosystem housing (15) has an inner shoulder (21) which engages the inner spring plate (13).

12. The hydrostatic variable displacement pump of claim 9, wherein an outer spring plate (14) is positioned about the servopiston (7) and operatively associated with the spring assembly (9, 10).

13. The hydrostatic variable displacement pump of claim 12, wherein the servo system housing (15) has an outer shoulder (22) which is adapted to intermittently engage the outer spring plate (14).

14. The hydrostatic variable displacement pump of claim 9, wherein the spring assembly (9, 10) is in fluid connection with the tank chamber (5) via an opening (20) in the servosystem housing (15).

* * * * *